US009963266B2

(12) United States Patent
Lutter

(10) Patent No.: US 9,963,266 B2
(45) Date of Patent: May 8, 2018

(54) COLLAPSIBLE CONTAINER

(71) Applicant: Michael Lutter, Hamburg (DE)

(72) Inventor: Michael Lutter, Hamburg (DE)

( * ) Notice: Subject to any disclaimer, the term of this patent is extended or adjusted under 35 U.S.C. 154(b) by 0 days. days.

(21) Appl. No.: 14/407,522

(22) PCT Filed: Jun. 4, 2013

(86) PCT No.: PCT/EP2013/061488

§ 371 (c)(1),
(2) Date: Dec. 12, 2014

(87) PCT Pub. No.: WO2013/186087

PCT Pub. Date: Dec. 19, 2013

(65) Prior Publication Data

US 2015/0151876 A1 Jun. 4, 2015

(30) Foreign Application Priority Data

Jun. 14, 2012 (DE) ..... 10 2012 105 186

(51) Int. Cl.

| | |
|---|---|
| ***B65D 21/08*** | (2006.01) |
| ***B65D 63/00*** | (2006.01) |
| ***B65D 43/02*** | (2006.01) |
| ***B65D 25/20*** | (2006.01) |
| ***B65D 6/18*** | (2006.01) |
| ***B65D 6/26*** | (2006.01) |

(52) U.S. Cl.

CPC ..... *B65D 21/086* (2013.01); *B65D 7/26* (2013.01); *B65D 7/30* (2013.01); *B65D 9/14* (2013.01); *B65D 9/22* (2013.01); *B65D 11/1833* (2013.01); *B65D 25/20* (2013.01); *B65D 43/02* (2013.01); *B65D 63/00* (2013.01)

(58) Field of Classification Search

CPC ... B65D 9/14; B65D 9/30; B65D 7/26; B65D 7/30; B65D 11/1833; B65D 63/00; B65D 21/086

USPC ..... 217/51, 46, 14; 220/520, 6; 229/101, 229/103, 183

See application file for complete search history.

(56) References Cited

U.S. PATENT DOCUMENTS

| | | | | |
|---|---|---|---|---|
| 141,389 A | | 7/1873 | Selling | |
| 604,076 A | * | 5/1898 | Owens | B65D 9/14 217/46 |

(Continued)

FOREIGN PATENT DOCUMENTS

| | | |
|---|---|---|
| CH | 0636821 A5 | 6/1983 |
| DE | 1216185 A | 5/1966 |

(Continued)

*Primary Examiner* — Andrew T Kirsch
*Assistant Examiner* — Jennifer Castriotta
(74) *Attorney, Agent, or Firm* — Porter Wright Morris & Arthur LLP

(57) ABSTRACT

The invention relates to a container (1) which comprises a first plurality of strips (11-1 to 11-15) which, in the unfolded state, form the base surface and at least one end wall of the container, and a second plurality of strips (12-1 to 12-9, 12-10 to 12-18) which, in the unfolded state, form at least one side wall of the container, the container in the unfolded state having a height, a length and a width, and wherein the container in the collapsed state can be substantially reduced to the width. Therefore optimal compact dimensioning of the container in the collapsed state is achieved.

21 Claims, 13 Drawing Sheets

(56) References Cited

U.S. PATENT DOCUMENTS

| | | | | | |
|---|---|---|---|---|---|
| 883,070 | A | | 3/1908 | Yeomans | |
| 1,056,491 | A | * | 3/1913 | Biddinger | B65D 9/14 217/14 |
| 1,067,129 | A | * | 7/1913 | Mignery | B65D 9/14 217/14 |
| 1,079,328 | A | * | 11/1913 | Clute | B65D 9/14 217/14 |
| 1,467,690 | A | * | 9/1923 | Schwarz | B65D 5/4287 206/315.1 |
| 1,743,702 | A | * | 1/1930 | Boeye | B65D 5/323 229/122.24 |
| 1,917,920 | A | * | 7/1933 | Bliss | B65D 5/448 229/199 |
| 2,025,420 | A | * | 12/1935 | Osgood | B65D 9/14 217/12 R |
| 2,136,762 | A | * | 11/1938 | Simmons | B65D 9/16 217/47 |
| 2,269,622 | A | * | 1/1942 | Downing | B65D 9/20 217/47 |
| 3,667,666 | A | | 6/1972 | Pryor | |
| 4,320,846 | A | | 3/1982 | Meyering et al. | |
| 4,763,831 | A | * | 8/1988 | Huang | B65D 5/0005 229/101 |
| 5,823,374 | A | | 10/1998 | Wu | |
| 2009/0090709 | A1 | * | 4/2009 | Shalomoff | B65D 11/1833 220/6 |
| 2012/0031897 | A1 | * | 2/2012 | Robinson | B65D 11/1833 220/6 |

FOREIGN PATENT DOCUMENTS

| | | | |
|---|---|---|---|
| DE | 2728365 | A | 1/1978 |
| DE | 4447026 | A1 | 8/1995 |
| DE | 19734126 | A1 | 11/1999 |
| EP | 0279488 | A1 | 8/1988 |
| FR | 1027913 | A | 5/1953 |
| WO | 2007/127742 | A2 | 11/2007 |

* cited by examiner

COLLAPSIBLE CONTAINER

FIELD OF THE INVENTION

The invention relates to a collapsible container, in particular a collapsible box which when in a collapsed state is reduced to an optimally small size.

STATE OF THE ART

Any form of container (e.g. a box) consisting of carton, wood or a similar suitable material endeavours to comprise a maximum volume (internal volume) while simultaneously comprising high stability and low intrinsic weight. The most diverse containers have been proposed in the most diverse fields (diverse above all in relation to the product to be stored in it), wherein a part of these containers is partially or wholly collapsible. This is done in order to prevent, in circumstances in which the container does not contain a product (e.g. when selling packing cases for example or when storing the container itself), the dead internal volume from wasting storage capacity.

In everyday life packing cases are well known, whereby when they are collapsed, the end walls and side walls are lying on top of each other and the bottom and lid also lie on top of each other like wings. As a result the collapsed carton becomes very flat (in the main its thickness becomes double the wall thickness) but it occupies an enormous amount of space in terms of width and length thereby making handling of the packing case very difficult.

The publication DE 44 47 026 A1 shows a carton, in particular a collapsible carton, preferably for shoes. The carton comprising a floor wall, four side walls arranged opposite each other and a stabilising element, can be stabilised in the upright position by means of the stabilising element. The stabilising element is formed of stabilising strips. Thus the collapsible cartons can be stacked on top of each other, do not disintegrate and are not damaged. The side walls are detachably connected with each other.

It remains to be stated that although a collapsible carton is disclosed in the above publication, this at least does not consist of strips (or tubes, rods etc.) which are arranged in the same direction. Also it has not been disclosed that the carton can be rolled up by means of the strip construction.

The publication DE 1 216 185 discloses a container made of cardboard, in particular for packaging tobacco or other materials which during transport suffer material shrinkage. Here the container consists of a flexible blank and comprises folding lines. The folding lines are folded in such a way that longitudinal edges are formed which consist of three layers of the blank. In order to ensure that the layers hold together, fastening means are arranged at such a distance from the hollow sections. The blanks are for example fixed by means of staples.

Thus the above publication discloses a container consisting of cardboard which can be collapsed, and strips which can be built up to obtain a completed object. But it does not disclose a carton which can be rolled up by means of the strip construction to form a storage device. Further the blank in the above publication exclusively refers to the circumferential side wall of a barrel; the floor is not taken into consideration.

The publication DE 27 28 365 A1 describes a collapsible carton which due to its construction retains its dimensional stability, despite a somewhat moist content. To this end a foldable connecting flap each exists between a floor part and the two side walls which is connected with the floor part and the side walls by bending edges.

Thus the above publication discloses a collapsible carton which consists of cardboard. However, what is not described is a carton which can be assembled by means of strips (or tubes, rods, etc.) or rolled up and assembled again.

The publication U.S. Pat. No. 3,667,666 discloses a storage box which is assembled from a single material blank to form a storage box.

Here again, what is disclosed, is not a collapsible carton which can be assembled or rolled up and again be assembled by means of a strip construction. Rather this publication is similar to the above described packing case with the exception that the entire carton in the non-assembled state then has a single material thickness in thickness direction.

The publication WO 2007/127742 A2 shows a box which is assembled by means of a strap at each end and then comprises a storage receptacle or a bowl.

Thus what is disclosed here is a collapsible box which however does not consist of strips (or tubes, rods, etc.) which are arranged in the same direction. Also it is not disclosed that the box can be rolled up by means of the strip construction.

The FR 1027913 A shows a box where the two side walls, the base surface and the lid are connected with each other by means of articulated connecting elements. The two end walls are formed separately.

The EP 0279488 A1 describes a collapsible container which consists of several elements which are pivotally connected with each other along one edge.

The CH 636 821 A5 describes a container with a plurality of stiff container elements. The container elements are connected with each other via hinge-like connections. This row of elements is foldable to form an essentially closed prismatic block starting from a flat unfolded layer by means of a roll-up motion.

SUMMARY OF THE INVENTION: REQUIREMENT, SOLUTION, ADVANTAGES

In conclusion it is stated that a plurality of containers are present in the art which, however, are insufficient as regards their compactness in the collapsed or non-assembled state.

Accordingly, in a first aspect, the invention provides a container which comprises a first plurality of strips which in the unfolded state form the base surface and at least one end wall of the container, and a second plurality of strips which, in the unfolded state, form at least one side wall of the container, the container in the unfolded state having a height, a length and a width, and wherein the container in the collapsed state can be substantially reduced to the width.

Further the first plurality of strips and the second plurality of strips are, as regards their respective main direction, aligned in the same direction.

Preferably the first plurality of strips comprises N strips, wherein N is preferably an integer greater than or equal to 5. The second plurality of strips comprises M strips wherein M is preferably an integer greater than or equal to 3. N is preferably greater than M.

Preferably the first plurality of strips, on its respective narrow side, is connected by means of a connector with a respective narrow side of the second plurality of strips in such a way that strips of the first plurality of strips protrude beyond the respectively outermost strip of the second plurality of strips in the direction transversely to the common main direction of the first and second plurality of strips. The protruding first strips form the end walls of the container.

In a second arrangement of the container the container preferably comprises at least one first through-connection which unites the first plurality of strips. Further the container preferably comprises at least one second through-connection which unites the second plurality of strips. The first or second through-connection preferably comprises an articulated shape. In a first alternative the first or second through-connection preferably extends essentially transversely to the main direction of the first or second plurality of strips and preferably consists of at least one band. In this case the first or second through-connection preferably consists of two to four bands. In a second alternative the first or second through-connection preferably consists of a net. In a third alternative the first or second through-connection preferably extends essentially transversely to the main direction of the first or second plurality of strips and preferably consists of at least one articulated rod.

In a third arrangement of the container the first plurality of strips, on their respective narrow side, is connected by means of a connector with a respective narrow side of the second plurality of strips in such a way that respectively (N-M)/2 strips of the first plurality of strips protrude beyond the respectively outermost strip of the second plurality of strips in the direction transversely to the common main direction of the first and second plurality of strips. The container preferably further comprises at least one closure element by means of which the respectively outermost strip of the second plurality of strips can be detachably connected with one of the protruding strips of the first plurality of strips. In a first alternative the protruding strip or the outermost strip preferably comprises at least one strap, and the closure element is preferably provided in the strap and the protruding strip or the outermost strip. In this case the closure element is preferably a press button pair and/or a magnetic head pair. In a second alternative the closure element is preferably made of a pair of hook and fleece Velcros.

In a fourth arrangement of the container each strip in the first plurality of strips and in the second plurality of strips comprises the same width, wherein the width of the strip is defined transversely to the main direction of the strips.

In a fifth arrangement of the container the container preferably further comprises at least one push-through eyelet in each strip of the first or second plurality of strips, wherein at least one stiffening element can be passed through the respective push-through eyelets.

In a sixth arrangement of the container the container further preferably comprises at least one strap on each strip of the first or second plurality of strips, wherein at least one stiffening element can be passed through the respective straps.

In the fifth or sixth arrangement the stiffening element preferably is one of a band and an articulated rod.

In a seventh arrangement of the container which includes the arrangement from third to sixth, the container is preferably collapsible from the completely unfolded state in such a way that the respectively protruding strips can be folded over onto the remaining strips of the first plurality of strips, and the second plurality of strips can be folded over onto the first plurality of strips. In a first alternative, following the folding-over of the second plurality of strips, the container is preferably collapsed further in such a way that the container can be rolled up transversely to the main direction of the first and second plurality of strips such that in the collapsed state the container comprises an essentially rectangular or square shape, wherein the largest dimension of the container in the collapsed state is the length, in main direction, of the first plurality of strips. In a second alternative following the folding-over of the second plurality of strips, the container can preferably be collapsed further in such a way that the container can be collapsed transversely to the first and second plurality of strips in the manner of an accordion, so that the container, in the collapsed state, comprises an essentially flat rod shape, wherein the largest dimension of the container in the collapsed state is the length, in main direction, of the first plurality of strips.

In a second aspect the invention provides for a container which comprises a container according to a first aspect, and a lid which is a second container according to the first aspect, wherein the lid comprises the same height or a smaller height than the first container and the lid comprises a marginally greater width and length than the first container, so that the lid can be placed over the first container.

SHORT DESCRIPTION OF THE DRAWINGS

Embodiments of the invention will now be described below with reference to the drawing, in which FIG. 1 shows a top view of the container according to the invention in a completely plane intermediate state (blank) from below;

Figure 1:
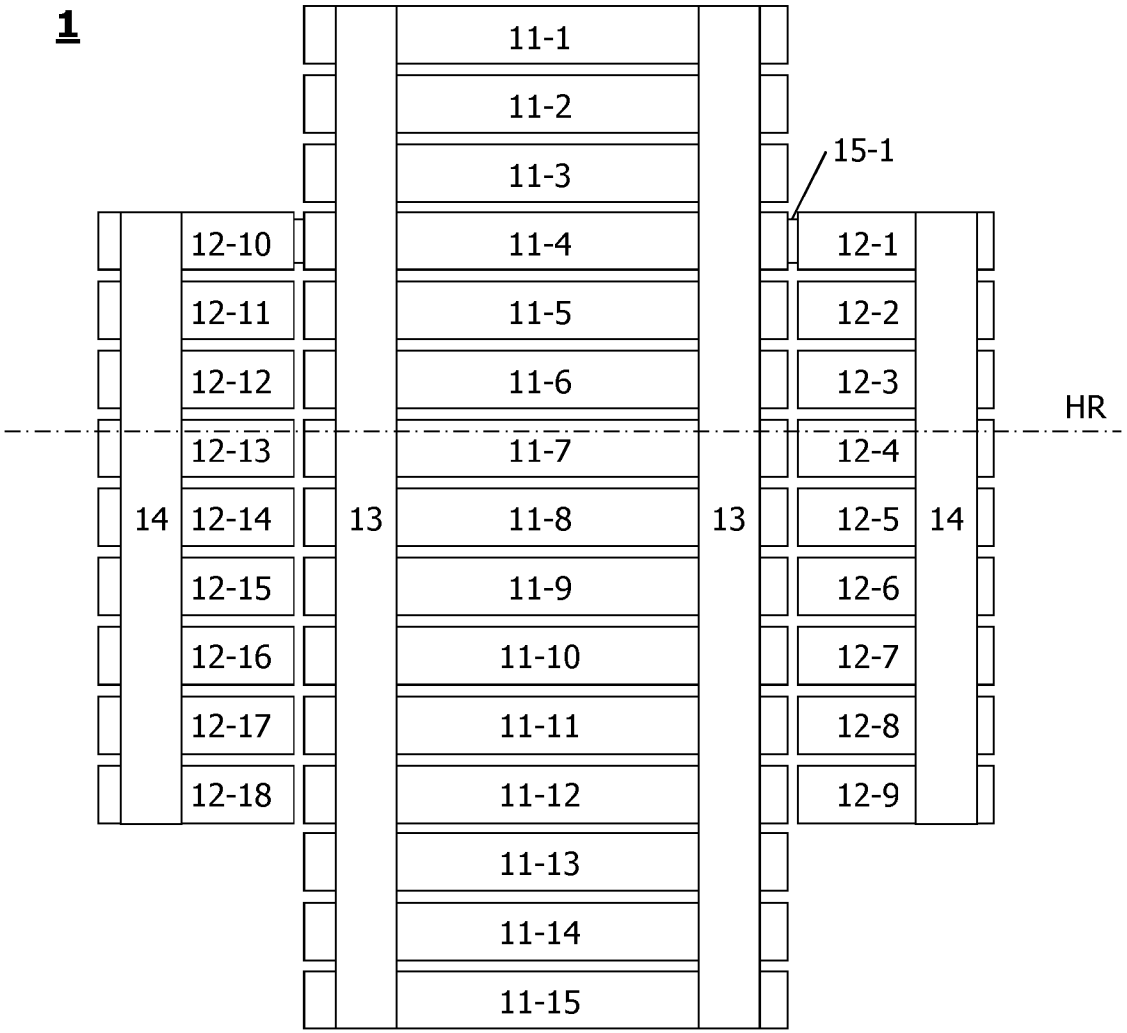
Figure 6B:
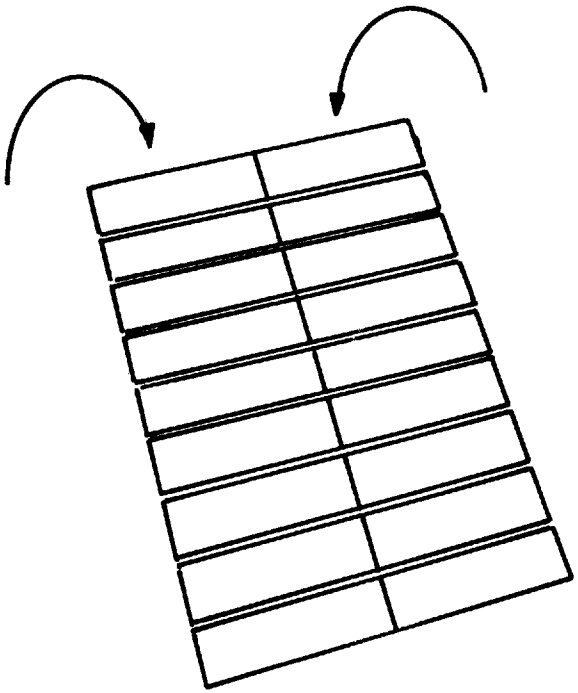
Figure 6A:
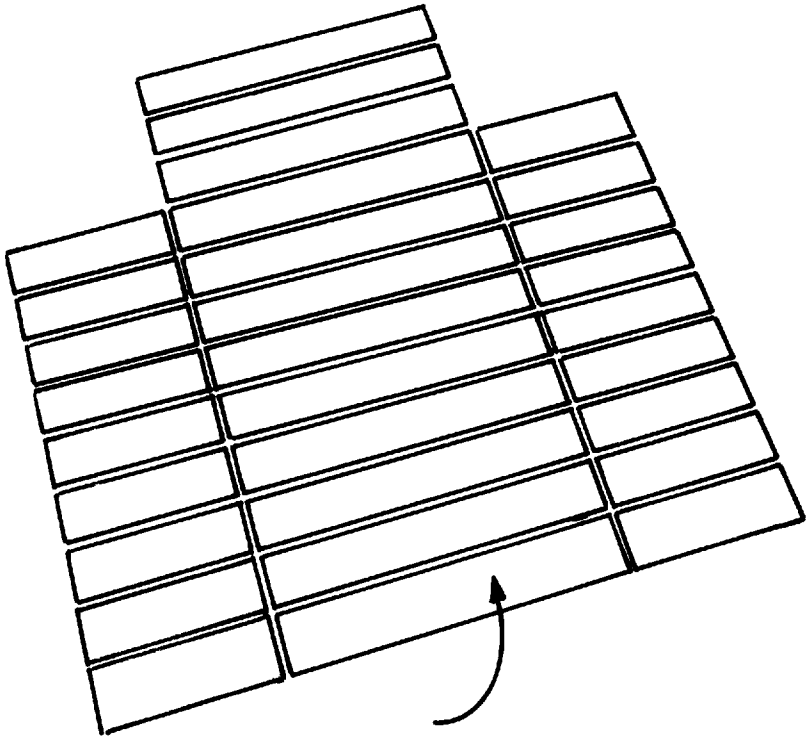
Figure 6D:
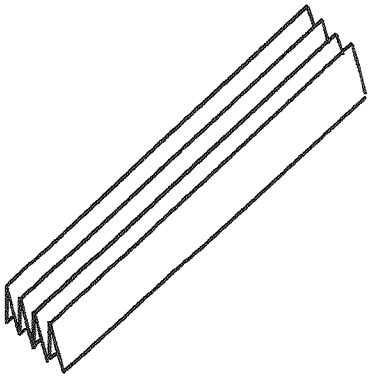
Figure 6C:
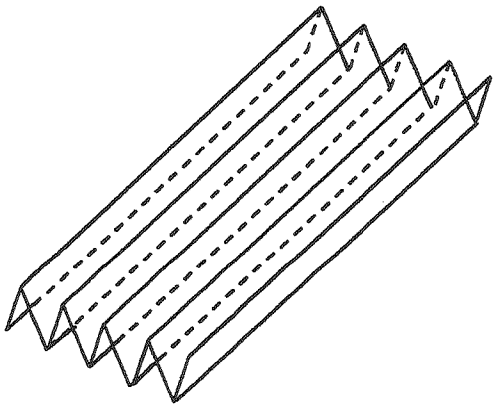
Figure 7B:
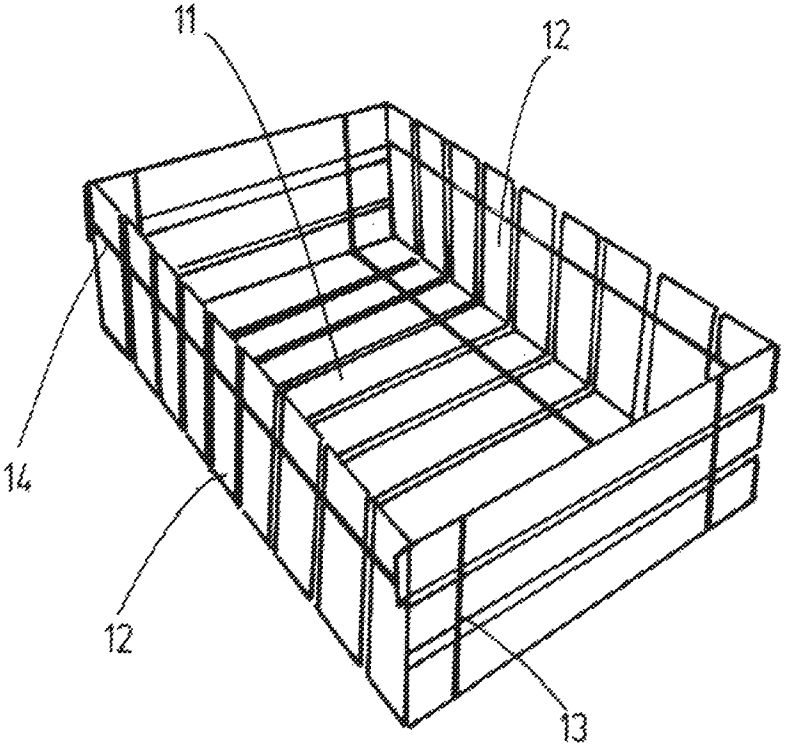
Figure 7A:
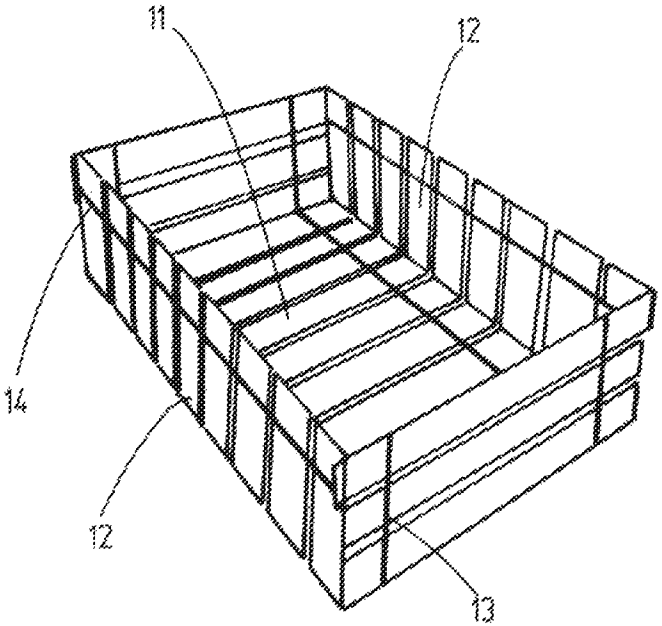

FIGS. 6A to 6D show a second alternative for changing the container from the intermediate state in FIG. 1 into the completely collapsed state; and FIGS. 7A and 7B show another embodiment, wherein a first container is shown in FIG. 7A and a second container with the same height but marginally greater width and length is shown in FIG. 7B, in which the second container is a lid which can be placed over the first container.

PREFERRED EMBODIMENT OF THE INVENTION

To start with it should be stated that the following components of the device according to the invention are described sometimes using their technical realisation (e.g. press button or magnetic head) and sometimes using their general shape (e.g. closure element). However, this does not restrict the general form to the actual technical realisation, but respectively represents merely an embodiment.

FIG. 1 shows a top view of a container 1 according to the invention in a completely plane intermediate state from below; in other words, FIG. 1 shows the blank for the container 1. The blank/the container 1 comprises a first plurality of strips 11-1 to 11-15, which in the assembled state form the floor and end walls of the container 1, and a second plurality of strips 12-1 to 12-18, which in the assembled state form the sidewalls of the container 1. Further, the container 1 may comprise through-connections 13 and 14 which respectively articulately link the first plurality of strips/the second plurality of strips. The "strips" may for example be cardboard strips as used in the embodiment described here; alternatively tubes, rods or other suitable elements may be used.

As shown in FIG. 1, the connections may be configured as at least one band (preferably two to four bands) 13, 14 which extend transversely to the main direction HR of the first and second plurality of strips 11, 12. The expert will be able to think of suitable connections between the respective strips 11, 12 and the bands 13, 14 using gluing, stapling, one-piece configurations or similar suitable measures.

Figure 2B:
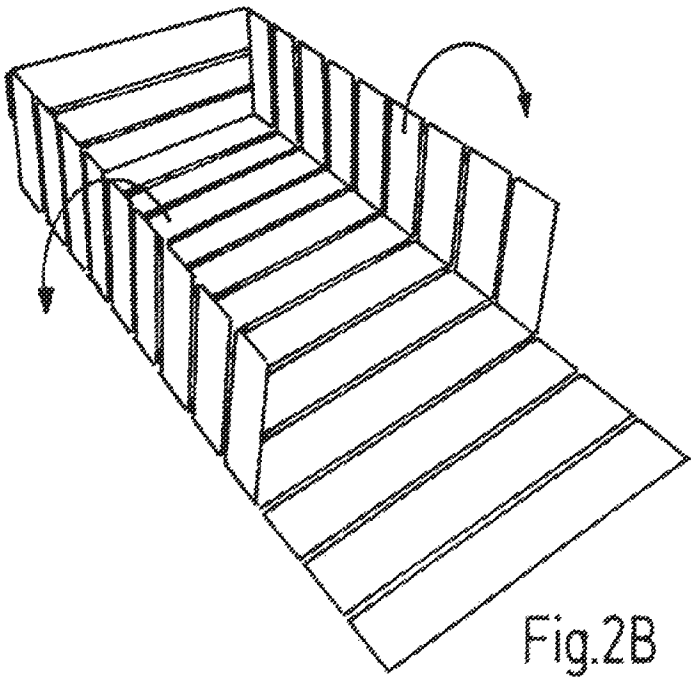
FIG. 2B shows how the container is unfolded.
Figure 2A:
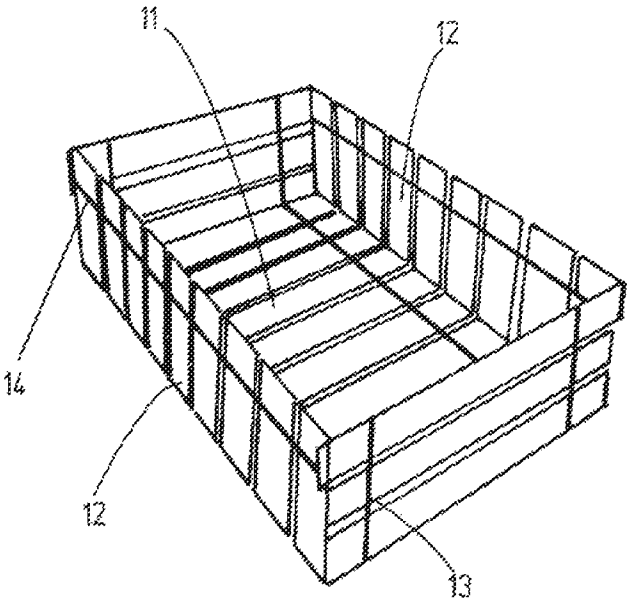
FIG. 2A shows the completely assembled container.
Figure 2C:
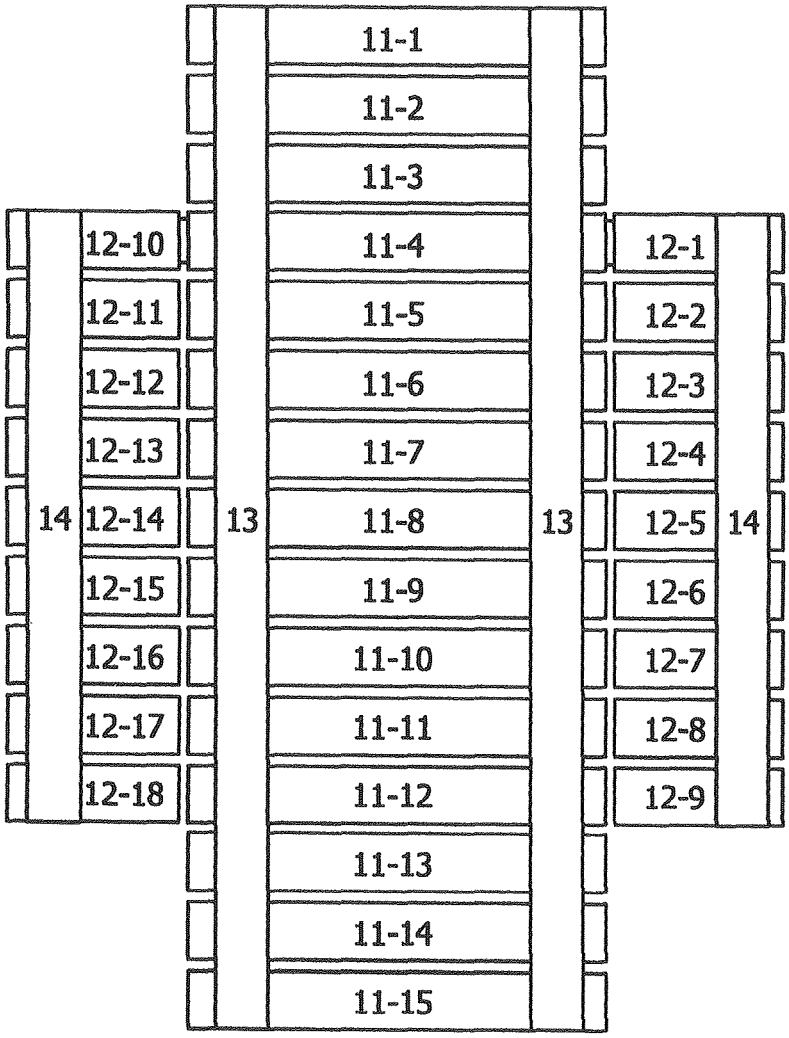
FIG. 2C shows the intermediate state of FIG. 1 as obtained through unfolding.
Figure 2D:
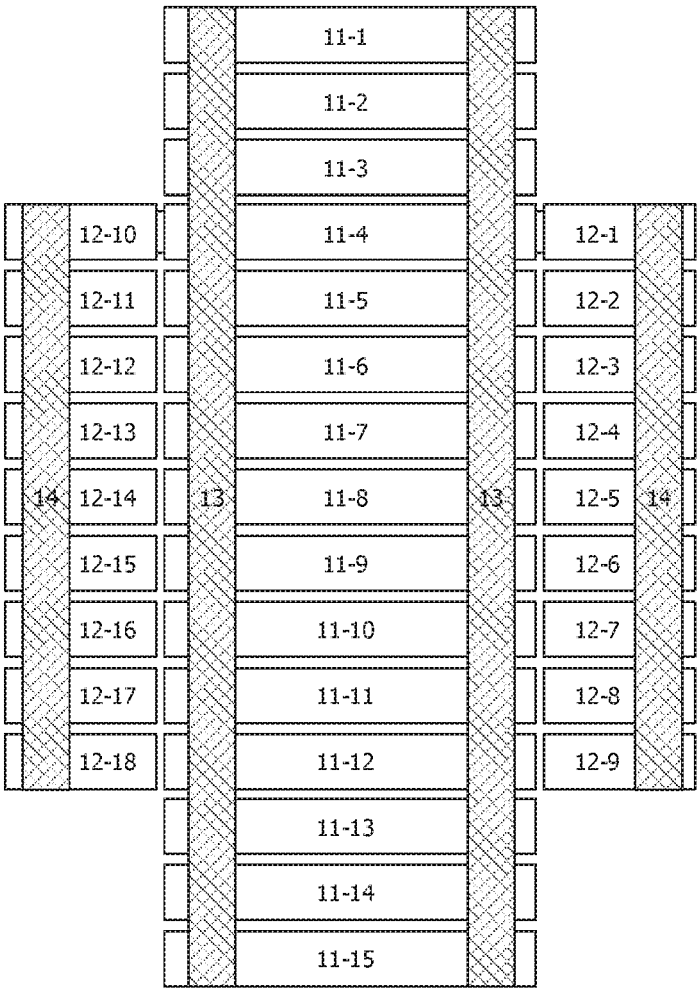
FIG. 2D shows an alternate embodiment of the container of FIG. 1 wherein the bands 13, 14 are formed of a net.

Alternatively, each of the bands 13, 14 may be formed of a net as shown in FIG. 2D, which extends across a part or over the whole of the first and second plurality of strips 11, 12. In a second alternative, instead of the bands, articulated rods (not shown) made from aluminium for example, may be used.

Finally it should be pointed out that in FIG. 1 the through-connections for the container are provided on the underside of the blank. Alternatively or additionally the through-connections can also be provided on the top of the blank.

As shown in FIG. 1 the first plurality of strips may comprise N strips, wherein N is an integer greater or equal 5, the second plurality of strips may comprise M strips, wherein M is an integer smaller N and greater or equal 3, the second plurality of strips, on its respective narrow side, may be connected by means of a connector 15-1 with a respective narrow side of the second plurality of strips in such a way that (N−M)/2 strips 11-1 to 11-3, 11-13 to 11-15 of the first plurality of strips respectively protrude beyond the respectively outermost strip 12-1, 12-9, 12-10, 12-18 of the second plurality of strips in the direction transversely to the common main direction of the first and second plurality of strips, and the protruding first strips may form the end walls of the container. Without any restriction on generality, the example in FIG. 1 shows 15 first strips 11, and 9 second strips 12 on each side of the first strips; this results in (15−9)/2=3 first strips 11, which respectively form the end walls of the container.

Further, FIG. 1, for simplicity, shows merely one connector 15-1 between a first strip 11-4 and the second strips 12-1 and 12-10. Such connectors may of course be provided between all first strips 11-4 to 11-12 and the respective second strips 12-1 to 12-9 and 12-10 to 12-18.

FIG. 2A shows the completely assembled container, FIG. 2B shows how the container is unfolded, and FIG. 2C shows the intermediate state of FIG. 1 obtained by unfolding (and which may also be called a "blank").

As shown in FIG. 2A the assembled container 1 has a width, a height and a length. As shown in FIG. 2B, by undoing (below-described) closure elements, the end walls and the longitudinal walls can in a simple manner be folded outwards in order to obtain the blank according to FIG. 1 (compare FIG. 2C).

Figure 3B:
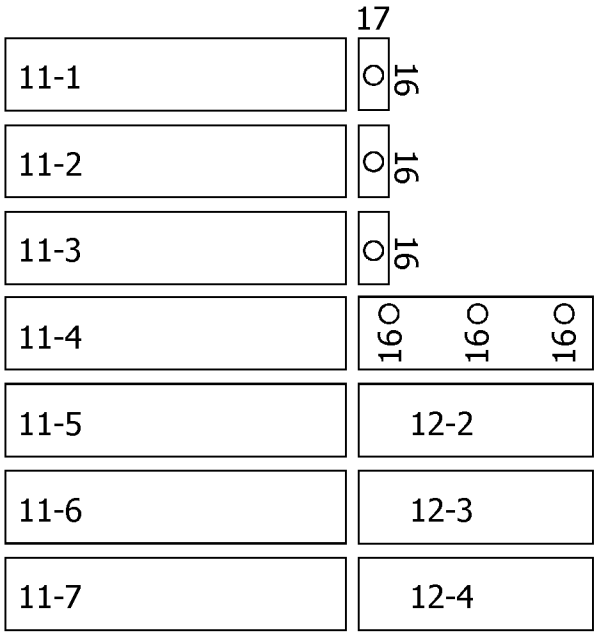
FIGS. 3A to 3C show three alternative arrangements of closure elements for fixing the side and end walls of the container.
Figure 3A:
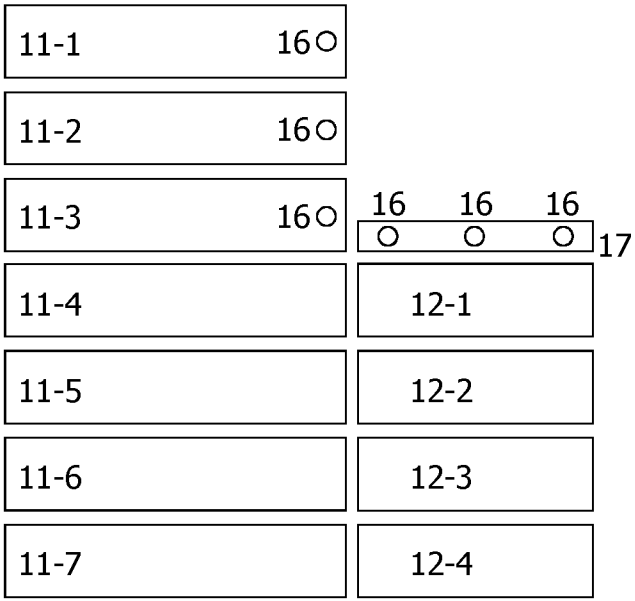
Figure 3C:
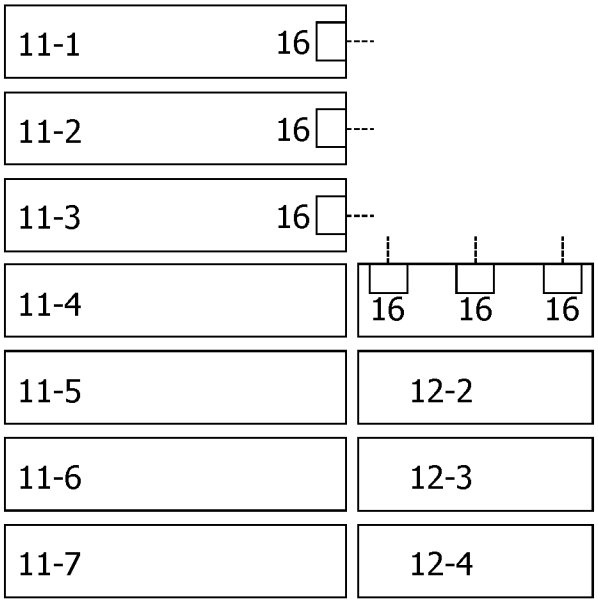

FIGS. 3A to 3C show three alternative arrangements of closure elements for fixing the sidewalls and end walls of the container. To begin with it should be pointed out that FIGS. 3A to 3C show only one attachment location for the closure elements 16; naturally for a cube-shaped container there will be four such attachment locations which essentially are identical to one another.

As shown in FIGS. 3A to 3C, the container 1 may comprise at least one closure element 16, by means of which the respectively outermost strip 12-1, 12-9, 12-10 and 12-18 of the second plurality of strips 12 may be detachably linked with one of the protruding strips 11-1 to 11-3, or 11-13 to 11-15 of the first plurality of strips.

As shown in FIGS. 3A to 3C, the protruding strip(s) 11-1 to 11-3 or the outermost strip 12-1 of the container 1 may comprise at least one strap 17, wherein the closure element 16 is provided in the strap 17 and in the protruding strip or the outermost strip. In this respect it is noted that "closure element" for example comprises a pair of press buttons or magnetic heads. In the case of press buttons the strap or the strip may accommodate a button part, whilst the correspondingly other strap or strip may accommodate the corresponding receptacle for the button part. In the case of magnetic heads the strap or the strip may accommodate a positive pole or a negative pole, whilst the correspondingly other strap or strip may accommodate the corresponding opposite pole.

As shown in FIG. 3C the closure element 16 may alternatively be a pair of hook and fleece Velcros. In this case the outermost strip 12-1 and the protruding strips 11-1 to 11-3 each include a hook Velcro or a fleece Velcro. By means of strips from the respective opposite Velcro (indicated in FIG. 3C by broken lines) the same closure can be achieved as in FIGS. 3A and 3B.

Further it should be noted that in FIG. 3A to §C the closure element 16 is provided on the underside of the blank (i.e. on the outside of the container). Alternatively or additionally the closure element 16 may be provided on the top of the blank (i.e. on the inside of the container).

Finally each strip in the first plurality of strips 11 and each strip in the second plurality of strips 12 may comprise the same width, wherein the width of the strips is defined transversely to the main direction HR of the strips.

In other words, the transverse wall and the sidewalls on the respective edge can be held together by means of closure elements, for example press buttons or magnetic heads or by means of Velcro closures in a strip construction. The closure elements may also be attached to the ends of the last strips of the collapsible carton because these strips compared to the other strips are then of a longer size and the ends are thus similar to straps. Possibly the container or the storage device may be collapsed by folding the straps over the edge together with the closure elements.

Figure 4A:
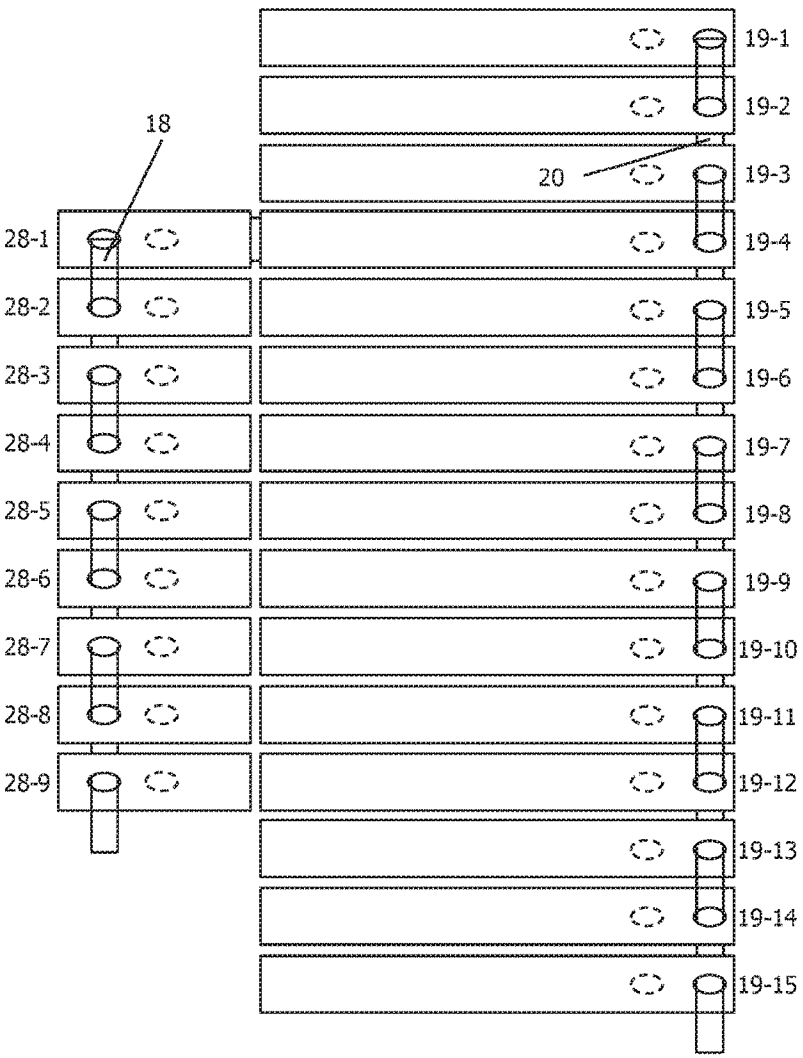
FIGS. 4A and 4B show two alternative arrangements of stiffening elements for stiffening the floor plate/the side wall.
Figure 4B:
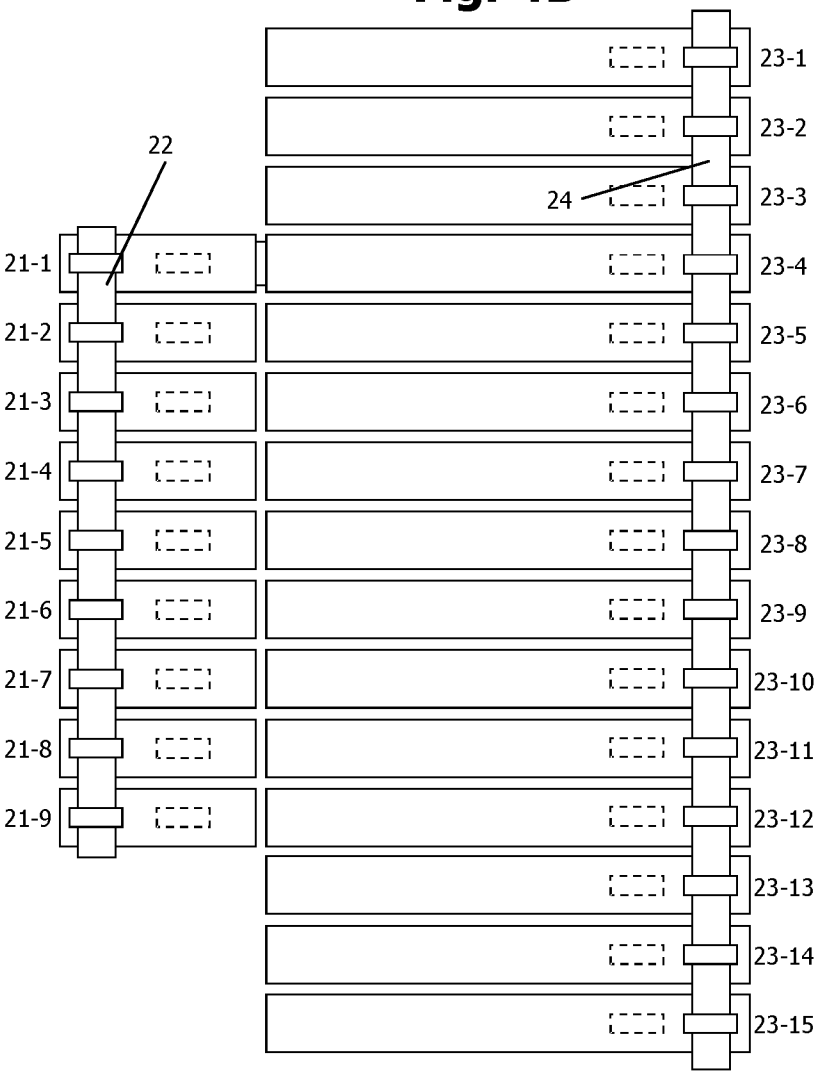

FIGS. 4A and 4B show two alternative arrangements of stiffening elements for stiffening the floor plate/the sidewall of the container 1. To make it easier FIGS. 4A and 4B describe the way it works with reference to the blank of FIG. 1.

As shown in FIG. 4A, the container 1 preferably comprises a push-through eyelet 28-1 to 28-9 in each strip 12 of the second plurality of strips, wherein at least one stiffening element 18 can be passed through the respective push-through eyelets. In this way the side part (or parts if applied to all side parts) may be stiffened. As indicated by the dashed push-through eyelets provision may be made for more than one stiffening element 18 in the side part, in order to ensure further stiffening.

As further shown in FIG. 4A, alternatively or additionally to the push-through eyelets 28-1 to 28-9 in the second strips 12, the container 1 may comprise a push-through eyelet 19-1 to 19-15 in each strip 11 of the first plurality of strips, wherein at least one stiffening element 20 can be passed through the respective push-through eyelet. In this way the floor part may be stiffened. As indicated by the dashed push-through eyelets provision may be made for more than one stiffening element 20 in the floor part in order to ensure further stiffening.

The stiffening element 18, 20 may, in both cases, be configured as a band, an articulated rod or a similar suitable element. As shown in FIG. 4A the stiffening element may be threaded in an alternating fashion through the push-through eyelets; but this does not exclude other suitable ways of threading.

As shown in FIG. 4B, the container 1 preferably comprises a strap 21-1 to 21-9 in each strip 12 of the second plurality of strips, wherein at least one stiffening element 22 can be passed through the respective strap. In this way the side part (or parts if applied to all side parts) may be stiffened. As indicated by the dashed straps provision may be made for more than one stiffening element 22 in the side part in order to ensure further stiffening.

Further as shown in FIG. 4B, alternatively or additionally to the straps 21-1 to 21-9 in the second strips 12, the container 1 may comprise a strap 23-1 to 23-15 in each strip 11 of the first plurality of strips, wherein at least one stiffening element 24 can be passed through the respective straps. In this way the floor part may be stiffened. As indicated by the dashed straps provision may be made for more than one stiffening element 24 in the floor part in order to ensure further stiffening.

The stiffening element 18, 20 may, in both cases, be configured as a band, an articulated rod or a similar suitable element. In the case of FIG. 4B the stiffening element may alternatively or additionally also be provided on the top of the blank (i.e. on the inside of the container).

In other words, since the stability of the side walls and in particular the base surface may be increased even more, push-through eyelets or straps may be arranged in sequence on the elements of the sidewalls, through which a further strip or the like is passed. This would stiffen the sidewalls and increase the stiffness of the whole construction. One could also imagine that one or more strips are passed along the base surface through corresponding straps or eyelets thereby also reinforcing the base surface.

FIGS. 5A to 5D show a first alternative for changing the container from the intermediate state (blank) of FIG. 1 into the completely collapsed state. FIGS. 6*a* to 6D show a second alternative in order to change the container from the intermediate state (blank) in FIG. 1 into the completely collapsed state.

As shown in FIGS. 5A, 5B, 6A and 6B, the first two steps are identical in both alternatives: starting from the completely unfolded state (blank) the container 1 can preferably be collapsed in such a way that the respectively protruding strips 11-1 to 11-3, 11-13 to 11-15 (i.e. the end walls of the container) are folded over onto the remaining strips 11-4 to 11-14 of the first plurality of strips 11 (i.e. the floor), and the second plurality of strips 12 (i.e. the sidewalls of the container) are folded over onto the first plurality of strips.

Figure 5B:
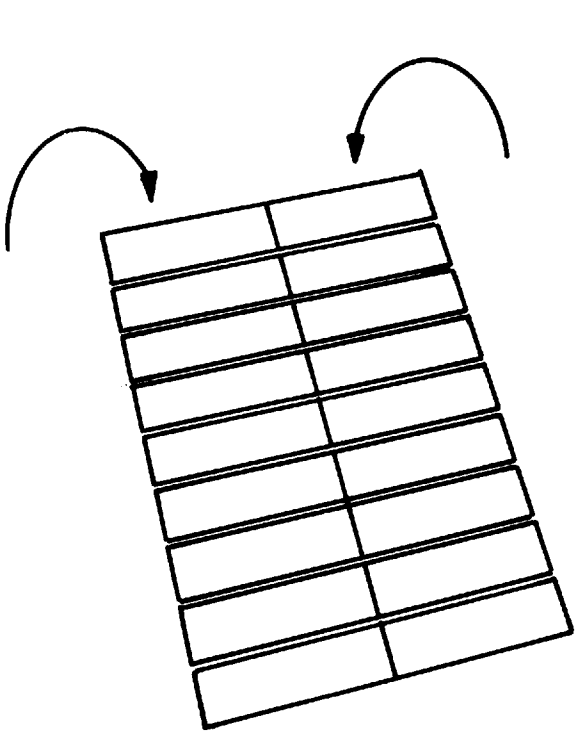
FIGS. 5A to 5D show a first alternative for changing the container from the intermediate state in FIG. 1 into the completely collapsed state.
Figure 5A:
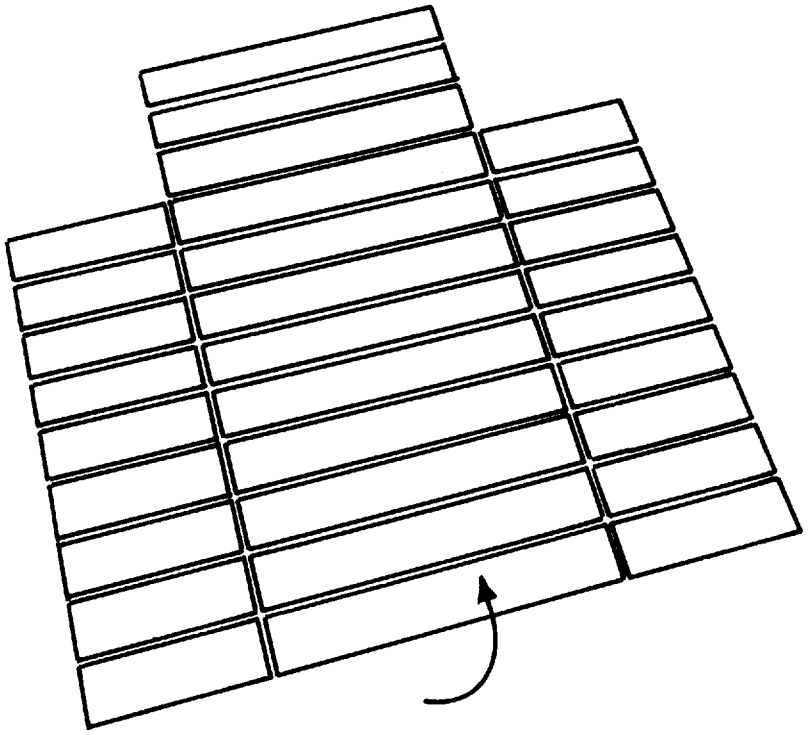
Figures 5C, 5D:
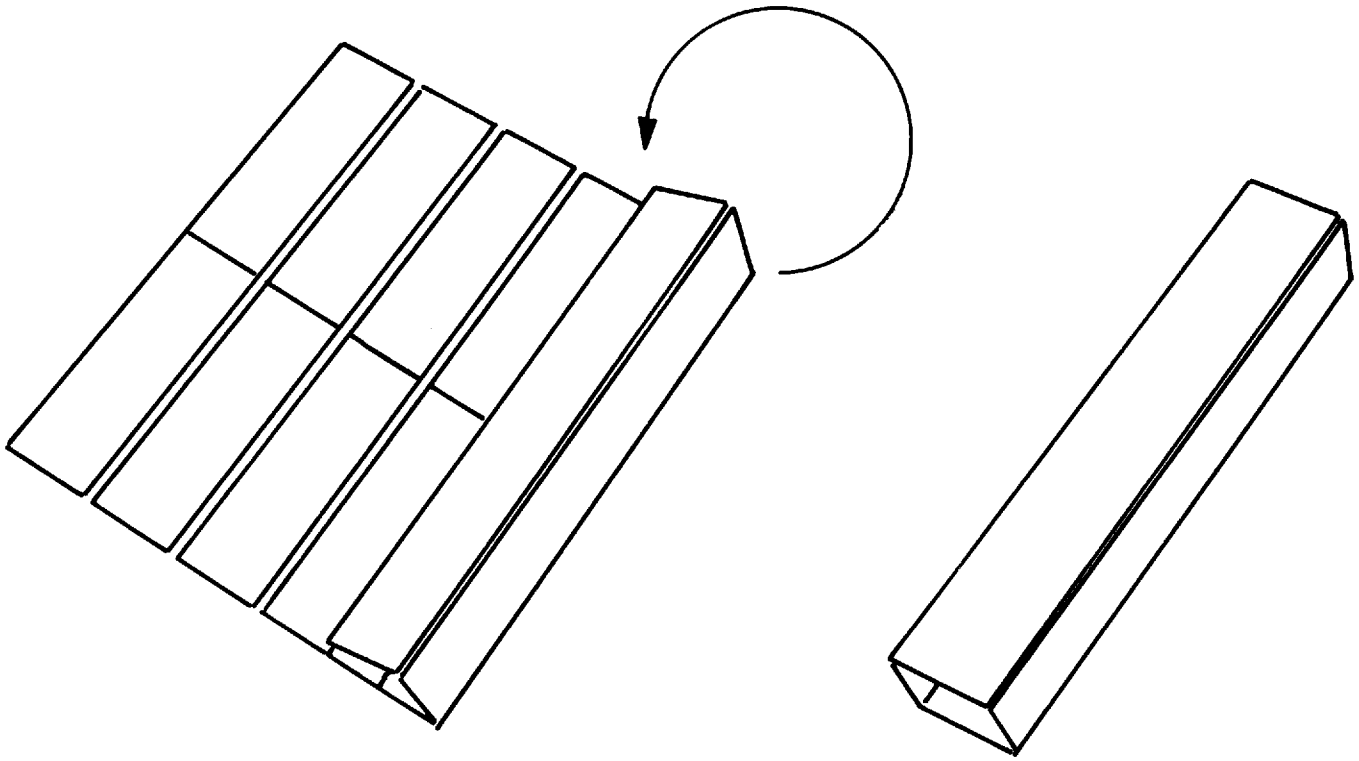

Then, as shown in FIGS. 5C and 5D, the container may preferably be rolled up transversely to the main direction HR of the first and second plurality of strips in such a way that in the collapsed state the container essentially comprises a rectangular or square shape, wherein the largest dimension, in the collapse state, is the length of the main direction of the first plurality of strips. In other words, the container is rolled up "over the longitudinal side".

Alternatively, as shown in FIGS. 6C and 6D, following the folding over of the second plurality of strips (i.e. sidewalls) the container can preferably be further collapsed in such a way as to collapse it further transversely to the main direction of the first and second plurality of strips like you compress an accordion, so that in the collapsed state, the container comprises an essentially flat rod shape, wherein the largest dimension of the container in the collapsed state is the length in the main direction of the first plurality of strips.

In conclusion it is stated that FIG. 1 in combination with FIG. 5 or FIG. 6 represents a complete system for changing the assembled container into a complete collapsed state and vice versa.

Finally the present invention also provides for the two containers to be combined, thereby forming a container with a lid, which comprises a first container 1 with some or all of the above described features, as shown in FIG. 7A, and a second container with some or all of the above described features acting as a lid, as shown in FIG. 7B, wherein the lid comprises the same or a smaller height than the first container, and the lid comprises a marginally larger width and length than the first container so that the lid can be placed over the first container.

The above description highlights the following advantages of the present invention:

After disconnecting the closure elements the container or the storage device can be rolled up by means of the strip construction.

The end product obtained is a "roll" with a rectangular or square cross-section, which can be carried along in a bag and which by unrolling and fitting together can be changed to obtain a box (container).

The invention claimed is:

1. A container having an assembled state and a collapsed state, comprising a first plurality of strips which in the assembled state forms a base surface and at least one end wall of the container;

a second plurality of strips which in the assembled state forms at least one sidewall of the container, the sidewall being perpendicular to the base surface in the assembled state;

at least one first through-connection which unites the first plurality of strips; and at least one second through-connection which unites the second plurality of strips;

wherein the first plurality of strips and the second plurality of strips each have individual, separate strips, wherein each strip has a strip length and a strip width, with the strip length being greater than the strip width, wherein the first plurality of strips and the second plurality of strips are arranged with their strip lengths aligned in the same direction (HR), wherein the length of each strip in the second plurality of strips is co-linear with the length of a strip in the first plurality of strips, wherein each strip has opposing edges along the width, and wherein adjacent width edges of at least one strip in the second plurality of strips and at least one strip in the first plurality of strips are connected, and wherein the container in the assembled state comprises a height, a length and a width, and the container in the collapsed state can essentially be reduced to the container width.

2. The container according to claim 1, wherein the first plurality of strips comprises N strips, wherein the second plurality of strips comprises M strips, wherein N is an integer greater than or equal to 5 and M is an integer greater than or equal to 3.

3. The container according to claim 1, wherein the first and/or second through-connection comprises an articulated shape.

4. The container according to claim 1, wherein the first and/or second through-connection extends essentially transversely to the direction HR of the first and second plurality of strips and consists of at least one band.

5. The container according to claim 4, wherein the first and/or second through-connection consists of two to four bands.

6. The container according to claim 1, wherein the first and/or second through-connection consists of a net.

7. The container according to claim 1, wherein the first and/or second through-connection essentially extends transversely to the direction HR of the first and second plurality of strips and consists of at least one articulated rod.

8. The container according to claim 1, wherein the adjacent width edges of at least one strip in the second plurality of strips and at least one strip in the first plurality of strips are connected by means of a connector and wherein strips of the first plurality of strips respectively protrude beyond respective outermost strips of the second plurality of strips in a direction transverse to the direction HR of the first and second plurality of strips, and the protruding strips of the first plurality of strips form end walls of the container.

9. The container according to claim 8, further comprising:

at least one closure element, by means of which a respective outermost strip of the second plurality of strips can be detachably connected with one of the protruding strips of the first plurality of strips.

10. The container according to claim 9, wherein the protruding strip or the respective outermost strip comprises at least one strap, and the closure element is provided in the strap and the protruding strip or the outermost strip.

11. The container according to claim 10, wherein the closure element is a pair of press-buttons or a pair of magnetic heads.

12. The container according to claim 9, wherein the closure element is a pair of hook and fleece closures.

13. The container according to claim 8, wherein the container can be collapsed from the assembled state in such a way that the respectively protruding strips can be folded over onto the remaining strips of the first plurality of strips, and the second plurality of strips can be folded over onto the first plurality of strips.

14. The container according to claim 13, wherein following folding over the second plurality of strips the container can be collapsed further such that the container can be rolled up transversely to the direction HR of the first and second plurality of strips such that in the collapsed state the container comprises an essentially rectangular or square shape, wherein the largest dimension of the container in the collapsed state is the length in the direction HR of the first plurality of strips.

15. The container according to claim 13, wherein following folding over the second plurality of strips the container can be collapsed further such that the container can be collapsed transversely to the direction HR of the first and second plurality of strips like an accordion so that in the collapsed state the container comprises an essentially flat rod shape, wherein the larger dimension of the container in the collapsed state is the length in the direction HR of the first plurality of strips.

16. The container according to claim 1, wherein each strip of the first plurality of strips and the second plurality of strips comprises the same width, wherein the width of the strips is defined transversely to the direction HR of the strips.

17. The container according to claim 1, further comprising:

at least one push-through eyelet in each strip of the first or second plurality of strips, wherein at least one stiffening element can be passed through and removed from the respective push-through eyelets.

18. The container according to claim 17, wherein the stiffening element is one of a band and an articulated rod.

19. The container according to claim 1, further comprising:

at least one strap on each strip of the first or second plurality of strips, wherein at least one stiffening element can be passed through and removed from the respective strap.

20. The container comprising a first container according to claim 1, and a lid which is a second container according to claim 1, wherein the lid comprises the same or a smaller height than the first container, and the lid comprises a marginally greater width and length than the first container so that the lid can be placed over the first container.

21. The container according to claim 1, wherein the second plurality of strips in the assembled state forms one sidewall of the container, the sidewall being perpendicular to the base surface in the assembled state, wherein the container further comprises a third plurality of strips which in the assembled state forms a second sidewall of the container, the second sidewall being perpendicular to the base surface in the assembled state, wherein the third plurality of strips has individual, separate strips, wherein each strip in the third plurality of strips has a strip length and a strip width, with the strip length being greater than the strip width, wherein the third plurality of strips is arranged with the strip lengths aligned in the direction HR, wherein the length of each strip in the third plurality of strips is co-linear with the length of a strip in the first plurality of strips, wherein each strip in the third plurality of strips has opposing edges along the width, and wherein adjacent width edges of at least one strip in the third plurality of strips and at least one strip in the first plurality of strips are connected, and wherein strips of the first plurality of strips respectively protrude beyond respective outermost strips of the second plurality of strips and the third plurality of strips in directions transverse to the direction HR, and the protruding strips of the first plurality of strips form opposite end walls of the container.

* * * * *